US006508379B1

(12) United States Patent
Van De Pol-Klein Nagelvoort et al.

(10) Patent No.: US 6,508,379 B1
(45) Date of Patent: Jan. 21, 2003

(54) LEAK-FREE DRINKING CUP

(76) Inventors: Henriette Hermine Titia Van De Pol-Klein Nagelvoort, De Hulle 12, NL-7421 EC Deventer (NL); Jan Albert Henri Klein Nagelvoort, Julian van Stolberglaan 4, NL-6961 GD Eerbeek (NL); Alberthe Joan Klein Nagelvoort, P.A. Bernhardlaan 9, NL-6998 AS Laag-Keppel (NL); Henri Jan Albert Klein Nagelvoort, Bernhardlaan 9, NL-6998 AS Laag-Keppel (NL)

( * ) Notice: Subject to any disclaimer, the term of this patent is extended or adjusted under 35 U.S.C. 154(b) by 0 days.

(21) Appl. No.: 09/831,644

(22) PCT Filed: Nov. 12, 1999

(86) PCT No.: PCT/NL99/00692

§ 371 (c)(1),
(2), (4) Date: Jun. 18, 2001

(87) PCT Pub. No.: WO00/28864

PCT Pub. Date: May 25, 2000

(30) Foreign Application Priority Data

Nov. 13, 1998 (NL) ..... 1010555

(51) Int. Cl.[7] ..... A47G 19/22

(52) U.S. Cl. ..... 220/714; 220/719; 215/11.4; 215/11.5; 215/260

(58) Field of Search ..... 220/714, 713, 220/711, 717, 719, 501; 215/11.4, 11.5, 388, 17, 18, 260; 222/490, 492

(56) References Cited

U.S. PATENT DOCUMENTS

| | | | | |
|---|---|---|---|---|
| 5,542,670 A | | 8/1996 | Morano | |
| 5,651,471 A | * | 7/1997 | Green | 220/714 |

FOREIGN PATENT DOCUMENTS

| | | | |
|---|---|---|---|
| GB | 2266045 | | 10/1993 |
| GB | 2333770 A | * | 8/1999 |
| IT | 594286 | | 5/1959 |
| WO | WO9938423 | | 8/1999 |

* cited by examiner

*Primary Examiner*—Stephen Castellano
(74) *Attorney, Agent, or Firm*—Handal & Morofsky

(57) ABSTRACT

A leak-free drinking beaker comprises a container as well as a lid closing the container, a drink opening which opens into the interior of the container, and a valve extending over the drink opening, which valve is held in the closed position under a certain pretension and can be released against said pretension under the influence of a pressure difference. The valve is a double-acting non-return valve and comprises a flexible valve element and two separate valve seats, the valve element and one of the valve seats has a blocking action in a direction opposed to the direction in which the valve element has a blocking action with the other valve seat.

18 Claims, 4 Drawing Sheets

LEAK-FREE DRINKING CUP

The invention relates to a leak-free drinking beaker, comprising a container as well as a lid closing the container, a drink opening which opens into the interior of the container, and a valve, extending over the drink opening, between the drink opening and the container, which valve is held in the closed position under a certain pretension and can be released against said pretension under the influence of a pressure difference.

A drinking beaker of this type is disclosed in WO-A 9708979. The valve used in said beaker is in the form of a membrane in which a slit has been made. When drinking, the slit opens a little so that liquid flows from the drinking beaker. The disadvantage of this known drinking beaker is that the membrane does not seal well. If the drinking beakers falls over or is turned upside down, leakage can still occur as a result of the liquid pressure.

The aim of the invention is to provide a drinking beaker with which freedom from leaks is better guaranteed. This is achieved in that the valve is a double-acting non-return valve, comprising a flexible valve element and two separate valve seats, the valve element and one of the valve seats having a blocking action in a direction opposed to the direction in which the valve element has a blocking action with the other valve seat.

By virtue of the use of a double-acting non-return valve it is possible, on the one hand, to ensure good sealing against leakage whilst, on the other hand, the reduced pressure produced in the drinking beaker by drinking can nevertheless be released. The air that flows in on equalising the reduced pressure can also carry liquid residues back into the beaker, as a result of which subsequent dripping is virtually precluded.

The flexible valve element can be constructed in various ways. According to a simple embodiment, the flexible valve element comprises an annular membrane, one peripheral rim of which interacts with the one valve seat and the other peripheral rim of which interacts with the other valve seat.

The membrane can be a disc which has a central hole, the one valve seat being located opposite the one side of the disc at the outermost rim of the disc and the other valve seat being located opposite the other side of the disc at the innermost rim of the disc. Such a construction is simple and has the advantage that cleaning of the beaker and lid with valve can be carried out easily and reliably.

The two valve seats can be movable with respect to one another in the direction transverse to their plane to change the pretension under which the disc is in contact with the valve seats.

One of the valve seats is formed by that rim of a drinking spout which protrudes inside the lid. The other valve seat is formed by a pin which is coaxial with respect to the other valve seat. With this arrangement the disc is located between the two valve seats and is held in place by the pin which extends to some extent into the interior opening of the disc, Furthermore, the pin can be movable in the axial direction in order to vary the preloading between disc and valve seats.

The pin is preferably accommodated on a support that is mounted in the lid. Said support can be slidably mounted in the lid in order to vary the mutual spacing of the valve seats and thus the pretension in the valve, Preferably, the lid has a peripheral rim provided with a screw thread which interacts with a corresponding screw thread on the container, the support being slidable in the axial direction in said peripheral rim. The support interacts with the upper limit of the container such that when the lid is screwed on to the container the pretension between the membrane and the valve seats is adjustable.

Depending on the drink used and/or on the user, it is always possible to set the pretension such that, on the one hand, drinking remains possible, but leaking is prevented.

The peripheral rim has an axial extension which interacts with a sealing ring provided at the periphery of the container, which extension and sealing ring interact with one another over the entire screw region of the screw threads of lid and container.

The support is pretensioned in the direction towards the container.

The invention will be explained in more detail with reference to an illustrative embodiment shown in the figures.

Figure 1:
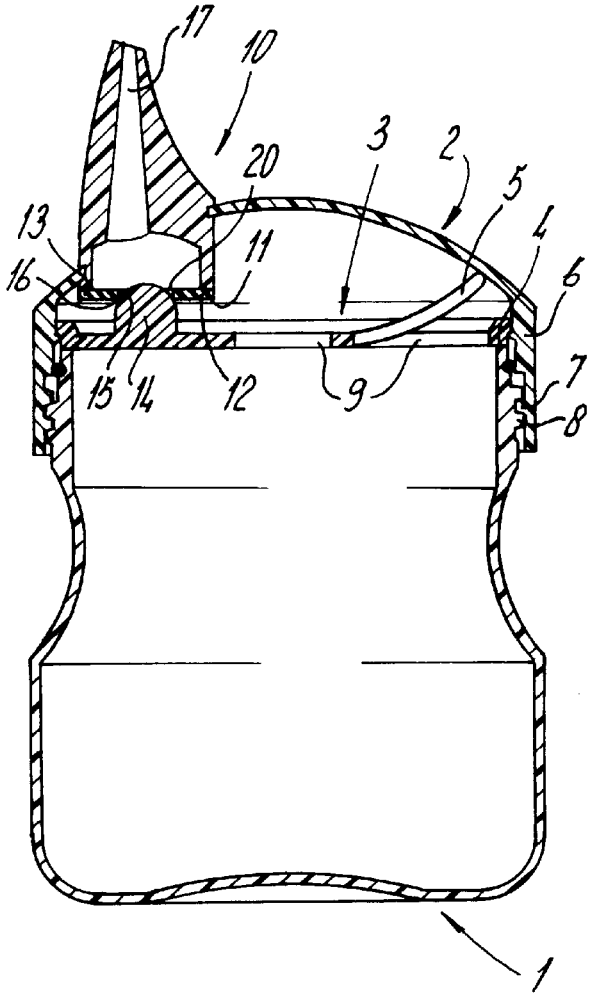
FIGS. 1 and 2 show a cross-section through the leak-free drinking beaker according to the invention.
Figure 2:
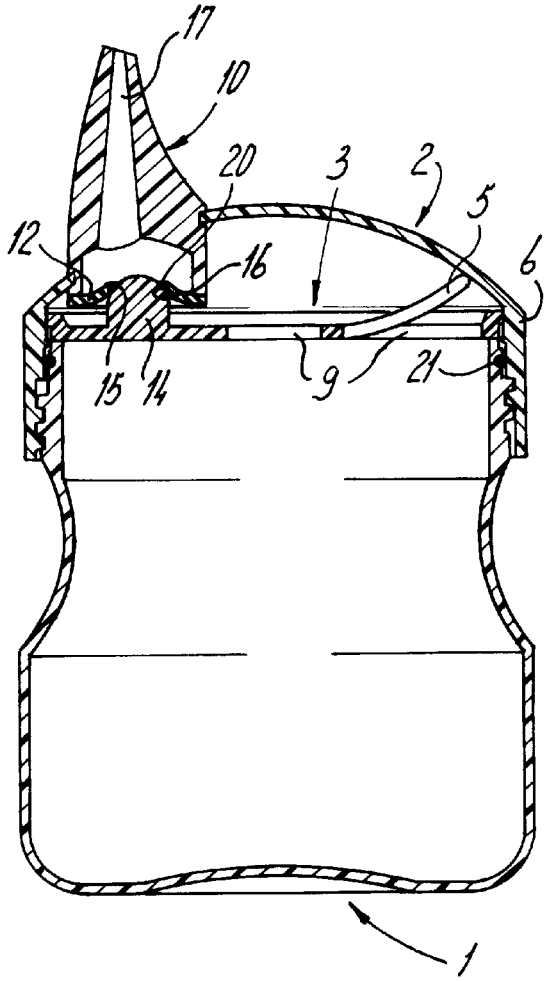
Figure 3:
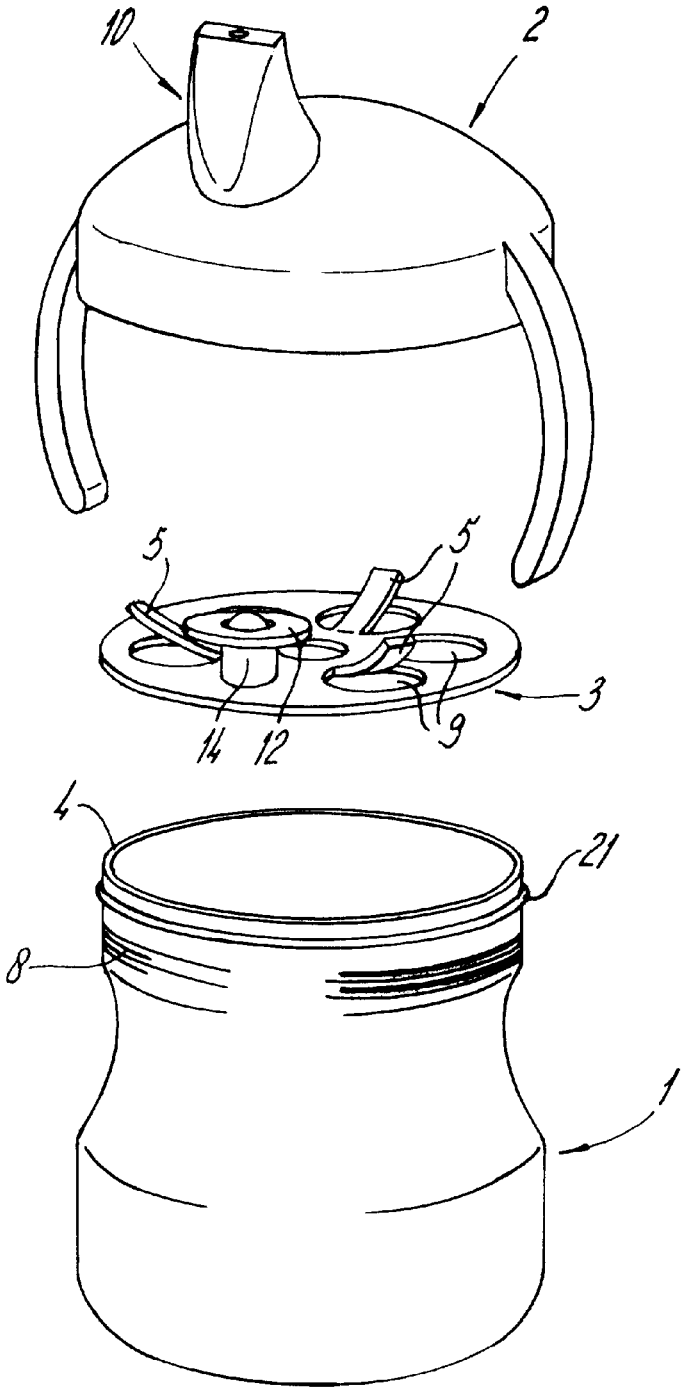
FIG. 3 shows an exploded view in perspective.

The leak-free drinking beaker shown in FIGS. 1 and 2 comprises a container 1 and a lid 2 screwed thereon. A support 3 is also accommodated between the container 1 and the lid 2. Said support 3 on the one hand bears on the top rim 4 of the container 1 and, on the other hand, is pretensioned against the inside of the lid 2 by means of fingers 5 forming one piece with the support.

The lid 2 has an annular rim 6, on the inside of which a screw thread 7 has been produced. The container 1 is provided at the top with corresponding screw thread 8, on to which the screw thread 7 of lid 2 is screwed.

The support 3 has holes 9 via which the liquid is able to flow from the container 1 to the spout 10 arranged in the lid 2.

That part of the spout 10 that extends into the lid 2 has an annular rim 11 which forms a first valve seat for the valve element 12, which in the example shown is constructed as an annular membrane. The outermost rim of the disc 13 of the annular membrane 12 interacts with the first valve seat 11.

A pin 14 is provided on the support 3, which pin 14 is coaxial with respect to the rim of the spout 10 forming the valve seat 11. Said pin 14 forms the second valve seat, which interacts with the inside edge 15 of the central hole 20 in the annular membrane.

Figure 4:
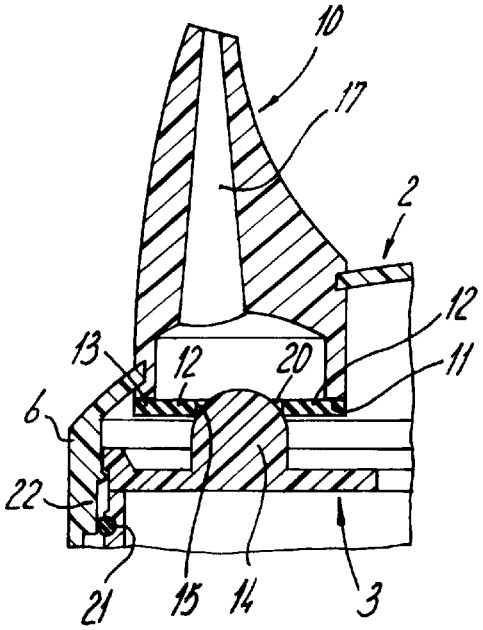
FIGS. 4–6 show details of the drink opening with valve element.

In the rest position the annular membrane 12 is in contact with both the first seat 11 and the second sent 16, determined by the surface of the pin 14. In this position the passage between the interior of the container 1 and the passage 17 in the spout 10 is blocked: see FIG. 4.

Figure 5:
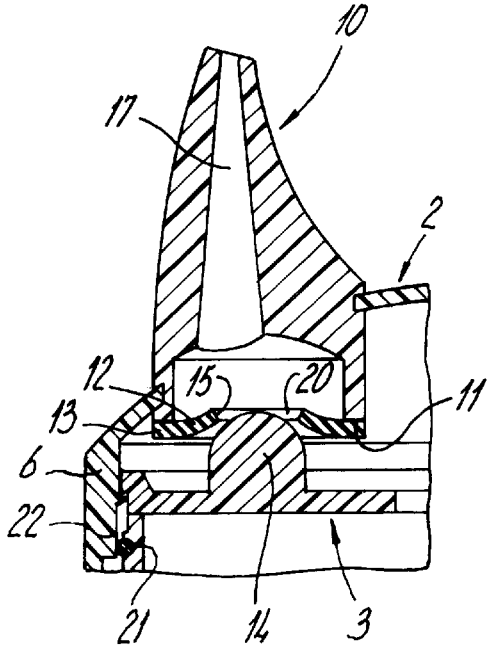

However, as soon as, as is shown in FIG. 5, a reduced pressure is generated in the passage 17, for example by sucking on it, the annular membrane 12 bulges slightly upwards, the rim 15 being lifted off the valve seat 16 determined by the pin 14. In this position the liquid is able to issue from the container 1 via the passage 17.

As soon as the reduced pressure is cancelled out, the rim 15 of the annular membrane 12 moves back on to the valve seat 16, as a result of which the passage is blocked again.

Figure 6:
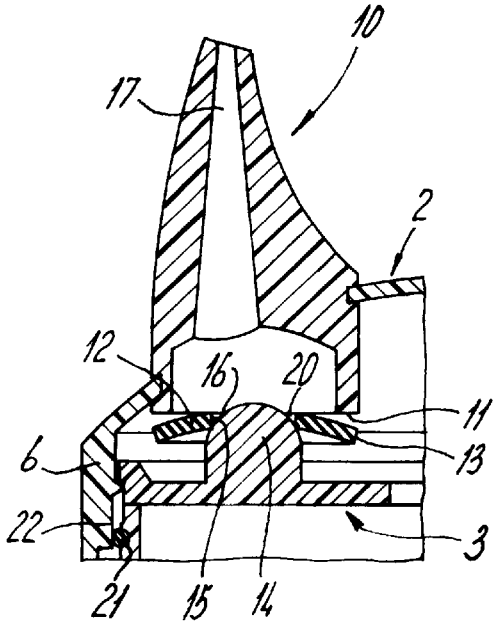

If a sufficiently high reduced pressure has been produced in the container 1, the outside edge 13 of the annular membrane 12 will then be lifted off the first valve seat 11, such that ambient air is able to flow into the container 1: see FIG. 6. During this operation any liquid that has remained behind in the passage 17 is guided back into the container 1, together with the inflowing air. Consequently subsequent dripping of the spout 10 can be prevented.

The opening of the annular membrane 12 in both directions is dependent on the pretension under which the edges 13, 15 interact with the respective valve seats 11, 16. The pretension can be adjusted, as will be explained with reference to FIGS. 1 and 2.

In the position shown in FIG. 1, the lid 2 has been screwed less far down on to the container 1, as a result of which the distance between the valve seats 11 and 16 in the vertical direction or in the direction of flow is relatively large. The annular membrane 12 will consequently be in contact with the valve seat under low pretension, as a result of which the membrane 12 opens easily.

In the position in FIG. 2, the lid 2 has been screwed further down on to the container 1. As a result the membrane 12 is pressed more firmly on to the valve seats 11, 16, as can also be deduced from the deformed state of said membrane 12.

In this case a greater reduced pressure in the passage 17 of the spout 10 is needed to open the membrane 12. This adjustment facility is useful to be able to vary the suction under which the membrane 12 opens.

The seal between lid 2 and container 1 is always guaranteed by the extension 20, provided on rim 6, which interacts with sealing ring 21, which is accommodated in the top rim of the container 1.

Figure 7:
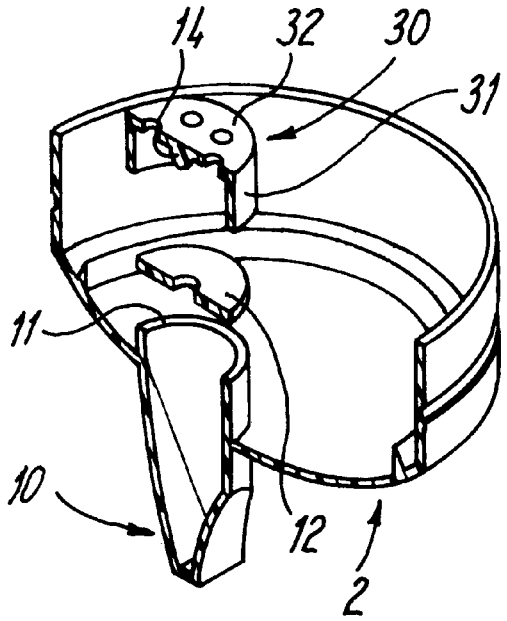
FIGS. 7–8 show details of a variant.
Figure 8:
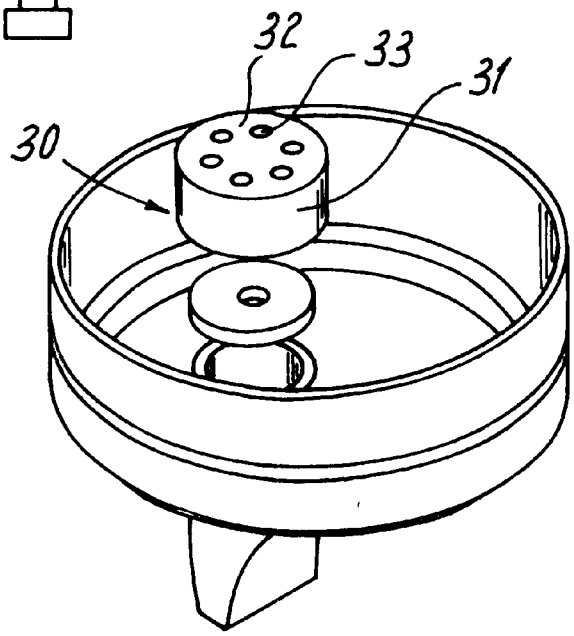

In the variant shown in FIGS. 7 and 8, the valve element 12 can be accommodated between the rim 11 of the spout 10 and a cap 30, the annular rim 31 of which is fixed to the spout 10.

The base 32 of the cap has holes 33 and carries the pin 14. Said pin 14 forms the second valve seat; the rim 11 forms the first valve seat.

The embodiment in FIGS. 7 and 8 has a fixed setting of the valve element 12 and in other respects functions in the same way as the embodiment in FIGS. 1–6.

What is claimed is:

1. A leak-free drinking beaker, comprising (a) a container, (b) a lid closing the container, (c) a drink passage opening into the interior of the container, and (d) a valve extending across the drink passage to control egress of liquid from the beaker and comprising:

(i) a resiliently flexible valve element, (ii) a first valve seat, and (iii) a second valve seat separate from the first valve seat wherein the valve element and the first valve seat are cooperable to block fluid flow in a first direction and the valve element is cooperable with the second valve seat to block fluid flow in a second direction, said first direction being opposed to said second direction, and wherein, in a rest position said valve element blocks flow of fluid in both directions and can be resiliently flexed to open by a reduced pressure respectively downstream of the first or second valve seat to permit fluid flow in either the first or the second direction, wherein the flexible valve element comprises an annular membrane, wherein the membrane is a disc having a central hole and a first side and a second side, the first valve seat is located opposite the first side of the disc at the outermost rim of the disc and the second valve seat is located opposite the second side of the disc at the innermost rim of the disc.

2. Drinking beaker according to claim 1, wherein the first and second valve seats are movable with respect to one another in the direction transverse to their respective planes to change the pressure needed to resiliently flex the disc.

3. Drinking beaker according to claim 2 having a drinking spout protruding inside the lid, wherein one of the valve seats is formed by a rim of the drinking spout.

4. Drinking beaker according to claim 2, wherein one of the valve seats is formed by a pin coaxial with respect to the other valve seat.

5. Drinking beaker according to claim 3, wherein the disc is located between the first valve seat and the second valve seat and the pin extends to the central hole of the disc, wherein the disc is held in a fixed position between the first valve seat and the second valve seat.

6. Drinking beaker according to claim 5, wherein the pin is movable in the axial direction to vary the pressure needed to resiliently flex the disc.

7. Drinking beaker according to claim 6, wherein the pin is fixed on a support, said support being mounted in the lid.

8. Drinking beaker according to claim 7, wherein the support is slidable with respect to the lid wherein the mutual spacing of the valve seats can be varied.

9. Drinking beaker according to claim 8, wherein the lid has a peripheral rim having a first screw thread and the container comprises an upper limit and a second screw thread mating with the first screw thread, the support being slidable in the axial direction in said peripheral rim, and the support interacts with the upper limit of the container such that when the lid is screwed on to the container the distance between the membrane and the first and second valve seats is adjustable.

10. Drinking beaker according to claim 9, wherein the peripheral rim has an axial extension which mates with a sealing ring provided at the periphery of the container, said extension and sealing ring mating with one another over the entire screw region of the screw threads of the lid and the container.

11. Drinking beaker according to claim 7, wherein the support is urged towards the container.

12. Drinking beaker according to claim 3, wherein one of the valve seats is formed by a pin which is coaxial with respect to the other valve seat.

13. Drinking beaker according to claim 4,wherein the disc is disposed between the first valve seat and the second valve seat and the pin extends to the central hole of the disc, wherein the disc is held in a fixed position between the first valve seat and the second valve seat.

14. Drinking beaker according to claim 8, wherein the support is urged towards the container.

15. Drinking beaker according to claim 9, wherein the support is urged towards the container.

16. Drinking beaker according to claim 10, wherein the support is urged towards the container.

17. Drinking beaker according to claim 11, wherein the support is urged towards the container by protrusions extending from the disc and abutting against the inside of the lid.

18. Drinking beaker according to claim 1, wherein if said reduced pressure is sufficiently high, the flexible valve member will be lifted off the first valve seat allowing ambient air to flow in to equalize air pressure wherein said ambient air forces liquid back into the container.

* * * * *